US007527086B2

(12) United States Patent
Wang et al.

(10) Patent No.: US 7,527,086 B2
(45) Date of Patent: May 5, 2009

(54) DOUBLE-ACTING DEVICE FOR GENERATING SYNTHETIC JETS

(75) Inventors: An-Bang Wang, Taipei (TW); Zdeněk Trávníček, Prague 8 (CZ); Yi-Hua Wang, Taipei (TW); Ming-Chang Hsu, Douliou (TW)

(73) Assignee: National Taiwan University, Taipei (TW)

( * ) Notice: Subject to any disclaimer, the term of this patent is extended or adjusted under 35 U.S.C. 154(b) by 648 days.

(21) Appl. No.: 10/894,613

(22) Filed: Jul. 20, 2004

(65) Prior Publication Data

US 2006/0016581 A1 Jan. 26, 2006

(51) Int. Cl.
*F28D 15/00* (2006.01)
*F28F 27/00* (2006.01)
*B05B 1/08* (2006.01)

(52) U.S. Cl. ..... 165/104.31; 165/96; 165/99

(58) Field of Classification Search ..... 165/46, 165/85, 96, 99, 101, 104.25, 104.31, 104.33, 165/908; 239/101, 102.1, 102.2
See application file for complete search history.

(56) References Cited

U.S. PATENT DOCUMENTS 4,708,601 A * 11/1987 Bazan et al. ..... 417/393
5,199,856 A * 4/1993 Epstein et al. ..... 417/312
5,742,954 A * 4/1998 Idland ..... 4/541.1
5,758,823 A * 6/1998 Glezer et al. ..... 239/4
6,056,204 A * 5/2000 Glezer et al. ..... 239/8
6,123,145 A * 9/2000 Glezer et al. ..... 165/104.33
6,471,477 B2 * 10/2002 Hassan et al. ..... 416/90 A
6,796,533 B2 * 9/2004 Barrett et al. ..... 244/208

FOREIGN PATENT DOCUMENTS

JP 2001050164 A * 2/2001

* cited by examiner

*Primary Examiner*—Tho v Duong
(74) *Attorney, Agent, or Firm*—Volpe and Koenig P.C.

(57) ABSTRACT

A double-acting device for generating a synthetic jet is provided. The double-acting device includes a chamber having a cavity for a working fluid, a separating element for dividing the chamber into at least two sub-chambers, a control system connected to the chamber for controlling the separating element to act reciprocatingly, an input system connected to the chamber for inputting the working fluid to the chamber therethrough and an output system connected to the chamber for outputting the working fluid from the chamber therethrough. When the working fluid is pushed and pulled by a reciprocating action of the separating element, a train of vortices would be puffed and a non-zero-net-mass-flux fluid is generated through a designed structure and a defined arrangement of the input system and the output system.

14 Claims, 14 Drawing Sheets

DOUBLE-ACTING DEVICE FOR GENERATING SYNTHETIC JETS

FIELD OF THE INVENTION

The present invention is related to a fluid actuator for generating synthetic jets, especially to the fluid actuator, which is applied to control the mixing of fluid flows and to control the fluid field and the fluid actuator, which is used in a cooling system.

BACKGROUND OF THE INVENTION

Conventional synthetic jets are periodic jets generated by pushing and pulling a fluid through an orifice of an actuator. While the actuator reciprocatingly acts, the fluid would be revolvingly oscillated, and be sucked into or jetted out from the actuator due to the pressure variation therein. Since the mass flux of the fluid sucked into the actuator is equal to that of the fluid jetted out, i.e. a time-mean mass flux of the oscillated fluid through this orifice is zero, the synthetic jets is so called as "Zero-Net-Mass-Flux jets" in early days. Other common expressions for such a generation of jets are "Suction and Blowing" and "Oscillatory Blowing".

Technically speaking, synthetic jets are generated by a periodic Zero-Net-Mass-Flux actuator, which can be arranged in various types. Please refer to FIG. 1(*a*), which illustrates the structure of a conventional Zero-Net-Mass-Flux actuator. The conventional Zero-Net-Mass-Flux actuator 1' has a sealed chamber 10' formed by a surrounding wall 11'. The surrounding wall 11' has an input orifice 113', at least one jetting element 115', such as an orifice or a nozzle, on one side of the chamber 10', and a diaphragm 12' (or a piston) on the other end of the chamber 10' for sealing. Mechanical energy for forcing the diaphragm 12' is supplied to the Zero-Net-Mass-Flux actuator 1' through various means, and the diaphragm 12' is sorted accordingly, such as the electromagnetic diaphragm, the electrodynamic diaphragm, the piezoelectric diaphragm, the electrostatic diaphragm, the thermopneumatic diaphragm, the bimetallic diaphragm, the electrohydrodynamic diaphragm, the shape memory material diaphragm and the pneumatic diaphragm. In short, a feeding from any mechanical energy source will keep the diaphragm 12' reciprocatingly acting.

Please refer to FIGS. 1(*b*) and 1(*c*), which illustrate the actions of the conventional Zero-Net-Mass-Flux actuator 1'. The diaphragm 12' is actuated toward the U direction during the up-stroke. The pressure inside the chamber 10' is hence getting lower, and a fluid 2', which is originally outside the Zero-Net-Mass-Flux actuator 1', would be sucked into the chamber 10' through the input orifice 113' for the pressure drop and hence forms a working fluid. The jetting element 115' is closed at that time, as shown in FIG. 1(*b*).

Referring to FIG. 1(*c*), accordingly, while during the back-stroke, the working fluid 3' in the chamber 10' is pushed because the diaphragm 12' is actuated toward the D direction. The pressure inside the chamber 10' will be increased, and the working fluid 3' sucked into the chamber 10' during the up-stroke is hence pushed. The working fluid 3' is pushed and jetted out through the input orifice 113' and the jetting element 115', and the jets are generated thereby.

Since the sucked working fluid in the up-stroke would be completely jetted out in the back-stroke, i.e. the mass flux of the sucked working fluid is equal to that of the jetted working fluid, the net mass flux of the working fluid, which flows in and out of the Zero-Net-Mass-Flux actuator 1', is zero in each of the reciprocatingly acting process of the diaphragm 12'.

On the other hand, if the working fluid flows in and out of the actuator through different jetting elements, the mass flux of the sucked working fluid would be hence different from that of the jetted working fluid, which may be resulted from changing the structure and the arrangement of the jetting elements of the actuator. For the respectively different mass fluxes of the sucked working fluid and the jetted working fluid, the net mass flux would not be zero. Non-Zero-Net-Mass-Flux jets would be generated therefore.

Based on the basic principles involved in the fluid mechanics, for considering the limitation of the Reynolds Number of the fluid, it needs a quite complicated arrangement of a pipe structure and moving parts for the fluid flows mixing controlling, the fluid field controlling, such as the fluid stream vectoring and the turbulence controlling, and for generating the fluid for a small-scale cooling system conventionally. This may further restrict the application of the conventional fluid in the small-scale system as a result.

However, when the synthetic jets are jetted through a jetting element, a vortex will be accordingly generated in the shear layer thereof. The fluid surrounding to the actuator will be further rolled by the vortex to induce an enhancement of the vortex. Besides, due to the simpler structure, the actuator for generating the synthetic jets is more beneficial for the applications in a small-scale system. Therefore, the synthetic jets are respectably potential for applications in the micro fluid mixing and the fluid field precisely controlling, and are broadly applied for the relevant applications.

Since the mass flux of the working fluid sucked into the actuator is equal to that of the working fluid jetted out during the reciprocatingly action of the Zero-Net-Mass-Flux actuator, the efficiency of the heat transfer would be slashed and the actuator will fail in cooling if the temperature difference between the fluids sucked in and jetted out is extremely small. Therefore, if a simpler method and device for generating the Non-Zero-Net-Mass-Flux fluid is provided, the temperature difference between the fluids sucked in and jetted out is able to be increased by repeatedly injecting a fresh fluid outside the actuator thereto. By the increased temperature difference and the enhancement of the fluid field, the Non-Zero-Net-Mass-Flux fluid can not only be applied for the conventional fluid field controlling, but also effectively improves in solving the thorny problem of the heat, which is generated by the high power electrical device.

Based on the above, in order to overcome the drawbacks in the prior art, a double-acting device for generating a Non-Zero-Net-Mass-Flux fluid and a cooling method therefor are provided in the present invention.

SUMMARY OF THE INVENTION

In accordance with the main aspect of the invention, a double-acting device for generating synthetic jets having a Non-Zero-Net-Mass-Flux is provided. The double-acting device includes a chamber having a cavity for a working fluid, a separating element for dividing the chamber into at least two sub-chambers, a control system connected to the chamber for controlling the separating element to act reciprocatingly, an input system connected to the chamber for inputting the working fluid to the chamber therethrough, and an output system connected to the chamber for outputting the working fluid from the chamber therethrough.

Preferably, the working fluid is pushed and pulled by a reciprocating action of the separating element.

Preferably, a train of vortices are puffed and a non-zero-net-mass-flux fluid is generated through a designed structure and a defined arrangement of the input system and the output system.

Preferably, the separating element is a piston.

Preferably, the control system is a system of connecting rods.

Preferably, the separating element is a diaphragm.

Preferably, the diaphragm is one of a piezoelectric film and a phonoelectric film.

Preferably, the control system is a control circuit.

Preferably, the input system and the output system further include a first control valve and a second control valve respectively.

Preferably, the first control valve and the second control valve are selected from an active valve and a passive valve.

Preferably, the input system further includes at least an input element.

Preferably, the input element is one of a diffuser and an orifice.

Preferably, the output system further includes at least two output elements respectively connected to the sub-chambers in the defined arrangement.

Preferably, the at least two output elements are selected from nozzles and orifices.

Preferably, the orifices are circular orifices.

Preferably, the output elements are coaxially arranged.

Preferably, the defined arrangement is one of a paired arrangement and an axisymmetric arrangement.

In accordance with another aspect of the present invention, a cooling method by generating a non-zero-net-mass-flux fluid is provided in the present invention, and the cooling method includes the steps of providing a heated body, providing a double-acting device having a chamber divided into at least two sub-chambers by a separating element, and controlling the separating element of the double-acting device to act reciprocatingly for passing a fluid in and out of each the sub-chamber and generating a train of vortices.

Preferably, the fluid is formed as antiphasely oscillating jets input to the sub-chamber through an input system and output from the sub-chamber through an output system, and the non-zero-net-mass-flux fluid is hence generated.

Preferably, a heat exchange of the heated body is induced by directing the non-zero-net-mass-flux fluid and the train of vortices to a surface of the heated body and driving a surrounding fluid to flow, and the heated body is cooled thereby.

Preferably, the chamber provides a cavity for the fluid working therein. The separating element is connected to the chamber for dividing the chamber into the two sub-chambers, the input system is connected to the chamber for inputting the fluid to the chamber therethrough, and the output system is connected to the chamber for outputting the fluid from the chamber therethrough.

Preferably, the separating element is controlled to pump by a control system connected to the chamber.

Preferably, the output system further has at least two output elements.

Preferably, the antiphasely oscillating jets are generated by a double-acting action of the separating element.

Preferably, a mutual interaction of the antiphasely oscillating jets is induced by a defined arrangement of the at least two output elements to enhance the train of vortices.

The foregoing and other features and advantages of the present invention will be more clearly understood through the following descriptions with reference to the drawings, wherein:

BRIEF DESCRIPTION OF THE DRAWINGS

FIGS. 1(*b*) and 1(*c*) are diagrams illustrating the fluid flowings during an up-stroke and a back-stroke of the conventional Zero-Net-Mass-Flux actuator, respectively;

FIGS. 2(*b*) and (*c*) are diagrams respectively illustrating the fluid flowings during an up-stroke and a back-stroke of the double-acting device for generating synthetic jets according to the first embodiment of the present invention;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1A:
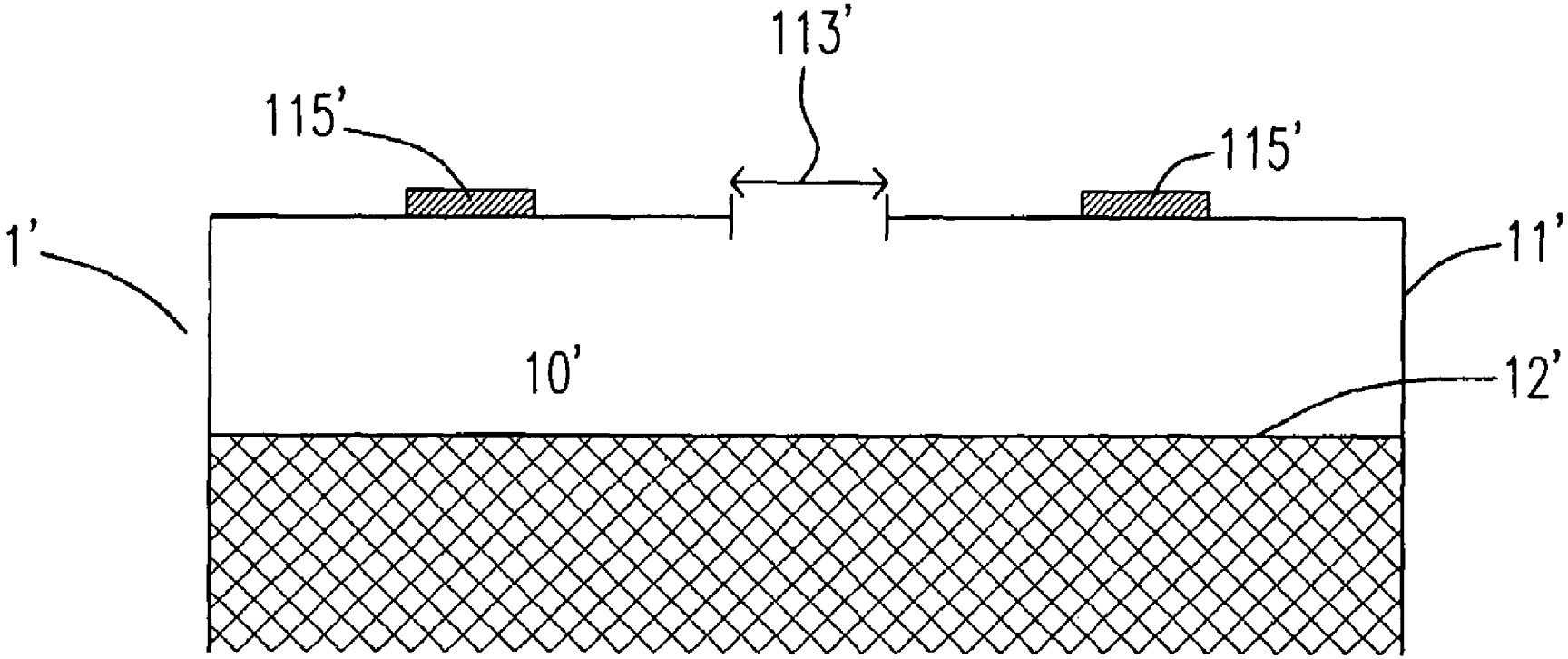
Fig. 1(a)(PRIOR ART)
FIG. 1(*a*) is a diagram illustrating the structure of the conventional Zero-Net-Mass-Flux actuator according to the prior art.
Figure 1B:
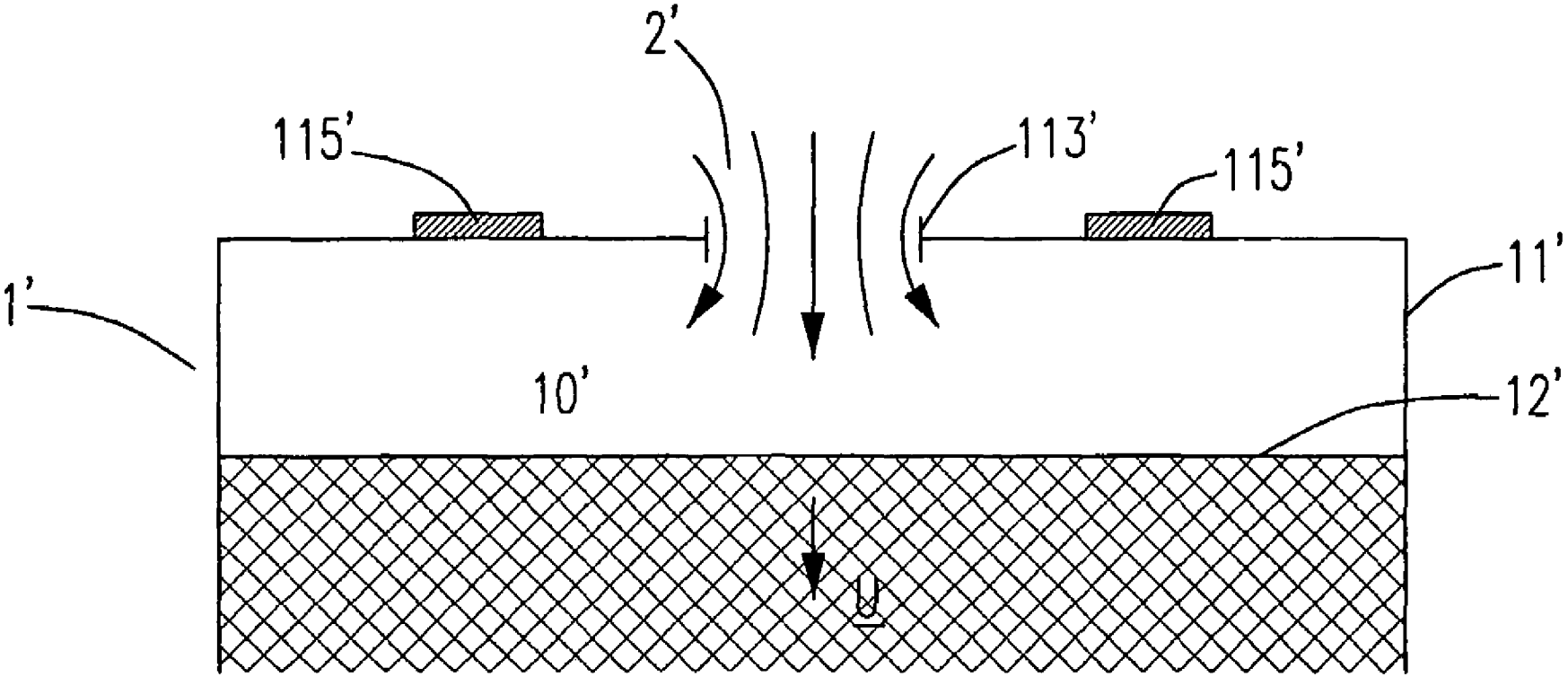
Fig. 1(b)(PRIOR ART)
Figure 1C:
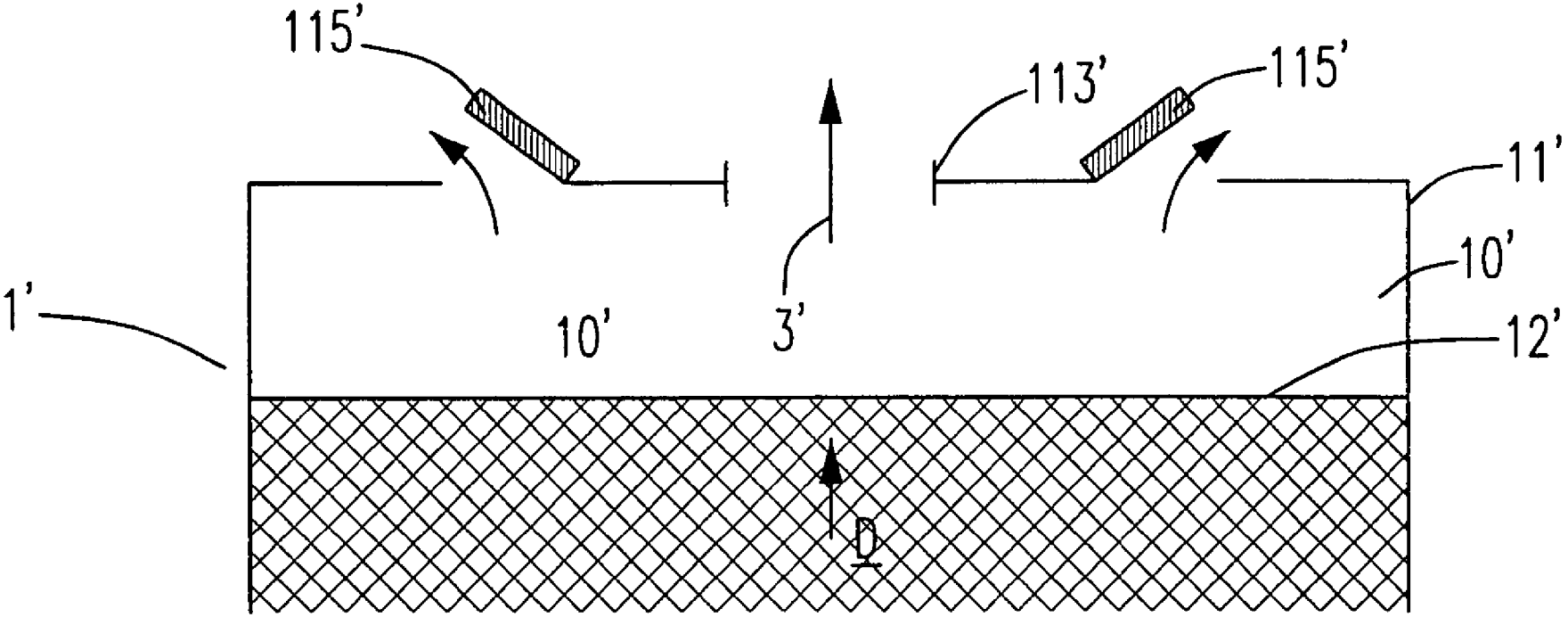
Fig. 1(c)(PRIOR ART)
Figure 2A:
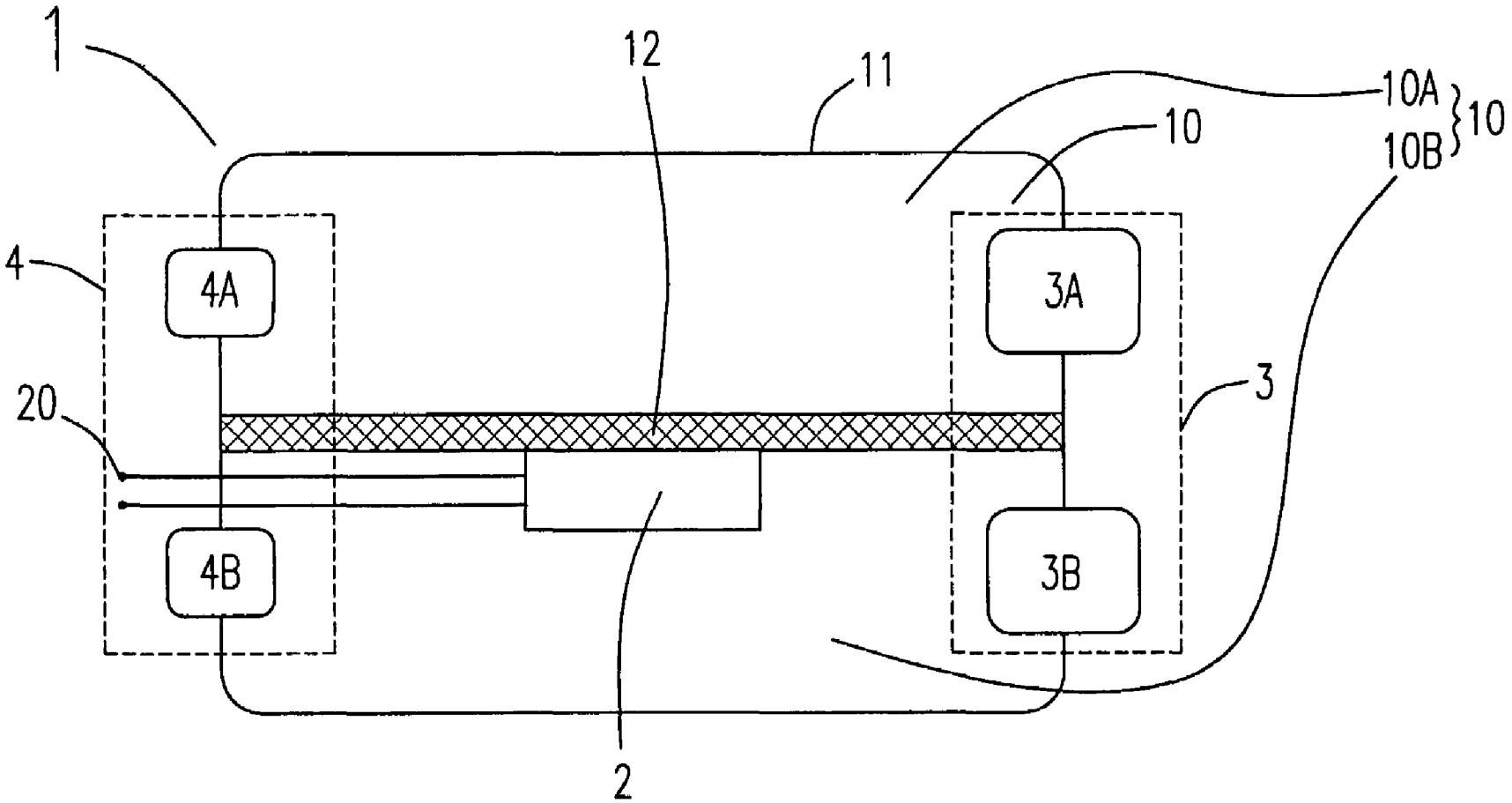
FIG. 2(*a*) is a diagram illustrating the structure of the double-acting device for generating synthetic jets according to a first embodiment of the present invention.
Figure 2B:
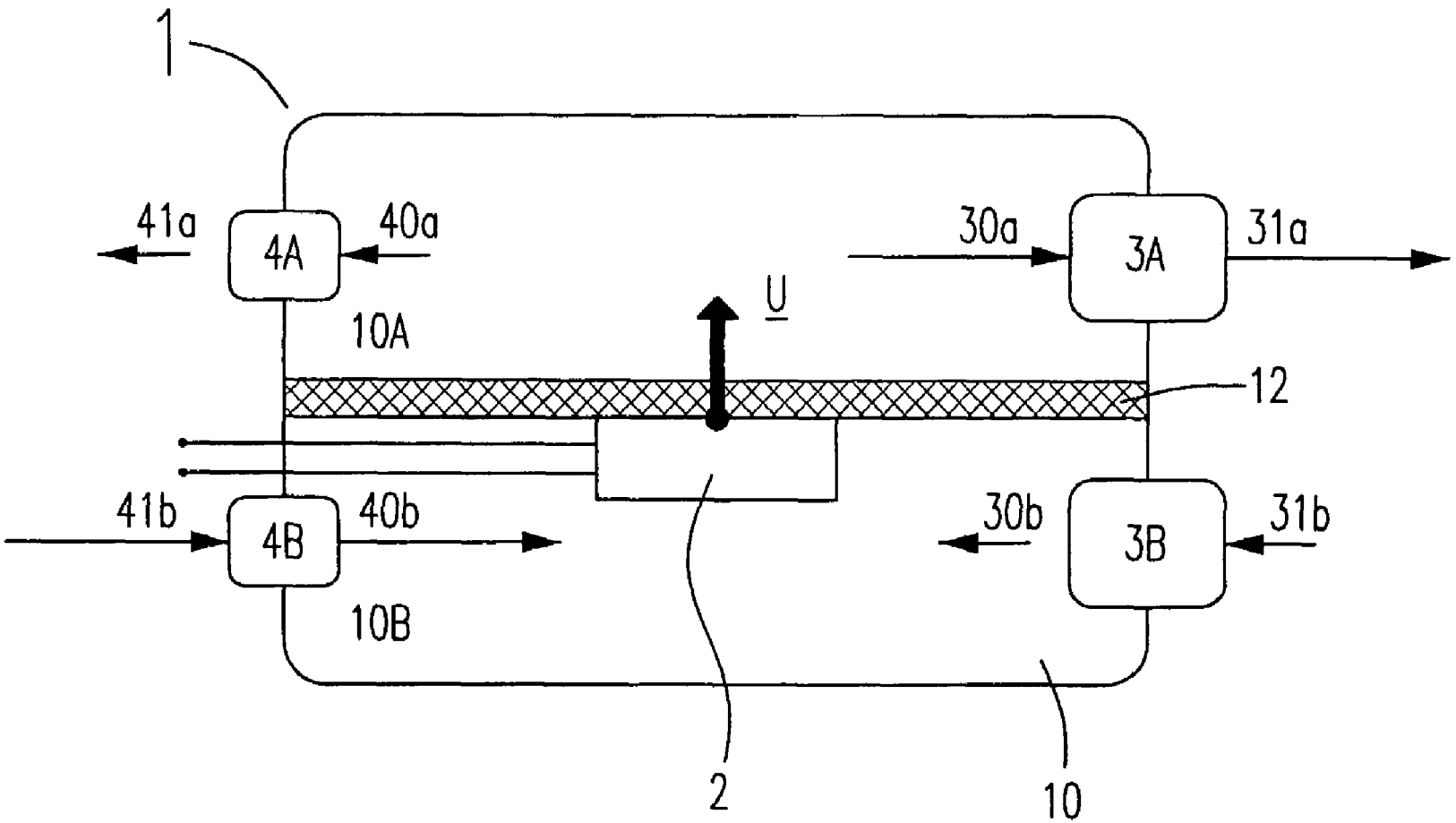
Figure 2C:
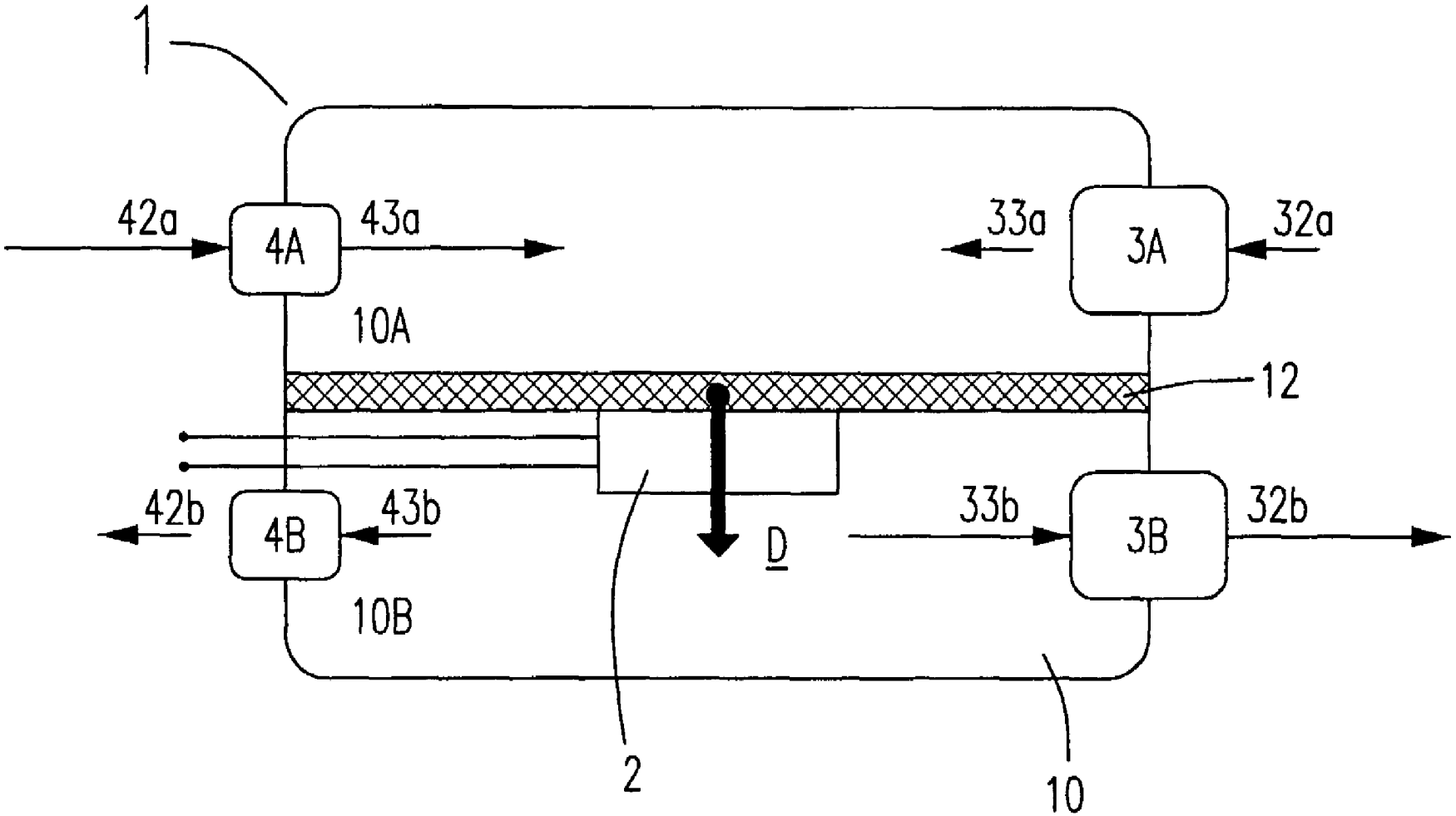

Please refer to FIGS. 2(*a*) to 2(*c*), which illustrate the structures of the double-acting device according to the first embodiment of the present invention. The double-acting device 1 of the present invention includes a sealed chamber 10 and a diaphragm 12 located therein to bisect the chamber 10 into two sub-chambers 10A and 10B. The input elements 4A and the output element 3A, and the input elements 3A and the output element 3B are respectively configured on the wall 11 of the sub-chamber 10A and 10B for respectively forming an input system 4 and an output system 3. Accordingly, the output elements 3A and 3B, and the input elements 4A and 4B are respectively arranged in two paired arrangements. A control circuit 2 is configured inside the chamber 10 to drive the diaphragm 12 and the electricity needed is provided by the power supply 20.

Please refer to FIG. 2(*b*). The diaphragm 12 driven by the control circuit 2 acts in a direction toward to the sub-chamber 10A, i.e. during the U direction, in the up-stroke. Due to the action of the diaphragm 12, the pressure of the fluid in the sub-chamber 10A is increased, and some of the working fluid 30*a* in the sub-chamber 10A is accordingly promoted to jet out through the output element 3A to further form the principal jets 31*a*. Moreover, the increased pressure in the sub-chamber 10A also results in a minor flowing of the fluid. In other words, some of the fluid 40*a* is accordingly jetted out from the sub-chamber 10A through the input element 4A to form minor jets 41*a*, if there is no additional check valve cooperated with the input element 4A. Additionally, the mass flux of the minor jets 41*a* depends on the structure and the size of the input element 4A.

On the other hand, there is only a periodic difference between the actions of the fluid in the sub-chambers 10A and 10B. Therefore, the working fluids 30*b* and 40*b* in the sub-chamber 10B will flow in a direction, which is opposite to that of the working fluids 30*a* and 40*a* in the sub-chamber 10A. That is to say, as the pressure inside the sub-chamber 10A is increased, the pressure inside the sub-chamber 10B will be decreased, and the fluid 41*b* outside the double-acting device 1 will be accordingly sucked into the sub-chamber 10B through the input element 4B and forms the working fluid 40*b*. Similarly, the fluid 31*b* is accordingly sucked into the sub-chamber 10B through the output element 3B to form the working fluid 30*b*, if there is no additional check valves cooperated with the output element 3B.

Please refer to FIG. 2(*c*). The diaphragm 12 driven by the control circuit 2 is pushed toward the direction away from the sub-chamber 10A, i.e. along the D direction, in the back-stroke of the double-acting device 1. The pressure inside the sub-chamber 10A will be decreased, and the fluid 42*a* outside the double-acting device 1 will accordingly flow into the sub-chamber 10A through the input element 4A to form a principal input fluid 43*a*. Moreover, the decreased pressure in the sub-chamber 10A also results in a minor flowing of the fluid. In other words, the fluid 32*a* is accordingly sucked into the sub-chamber 10A through the output element 3A to form the minor input fluid 33*a*, if there is no additional check valve cooperated with the output element 3A. Additionally, the mass flux of the minor input fluid 33*a* depends on the structure and the size of the output element 3A.

Considering the situation for the sub-chamber 10B, the fluid 33*b* inside the sub-chamber 10B is jetted out through the output element 3B owing to the increased pressure inside the sub-chamber 10B. The jet fluid 32*b* is hence generated. Similarly, some of the fluid 43*b* inside the sub-chamber 10B will be accordingly jetted out from the sub-chamber 10B through the input element 4B to form the jet fluid 42*b*, if there is no additional check valve cooperated with the input element 4B.

Figure 3:
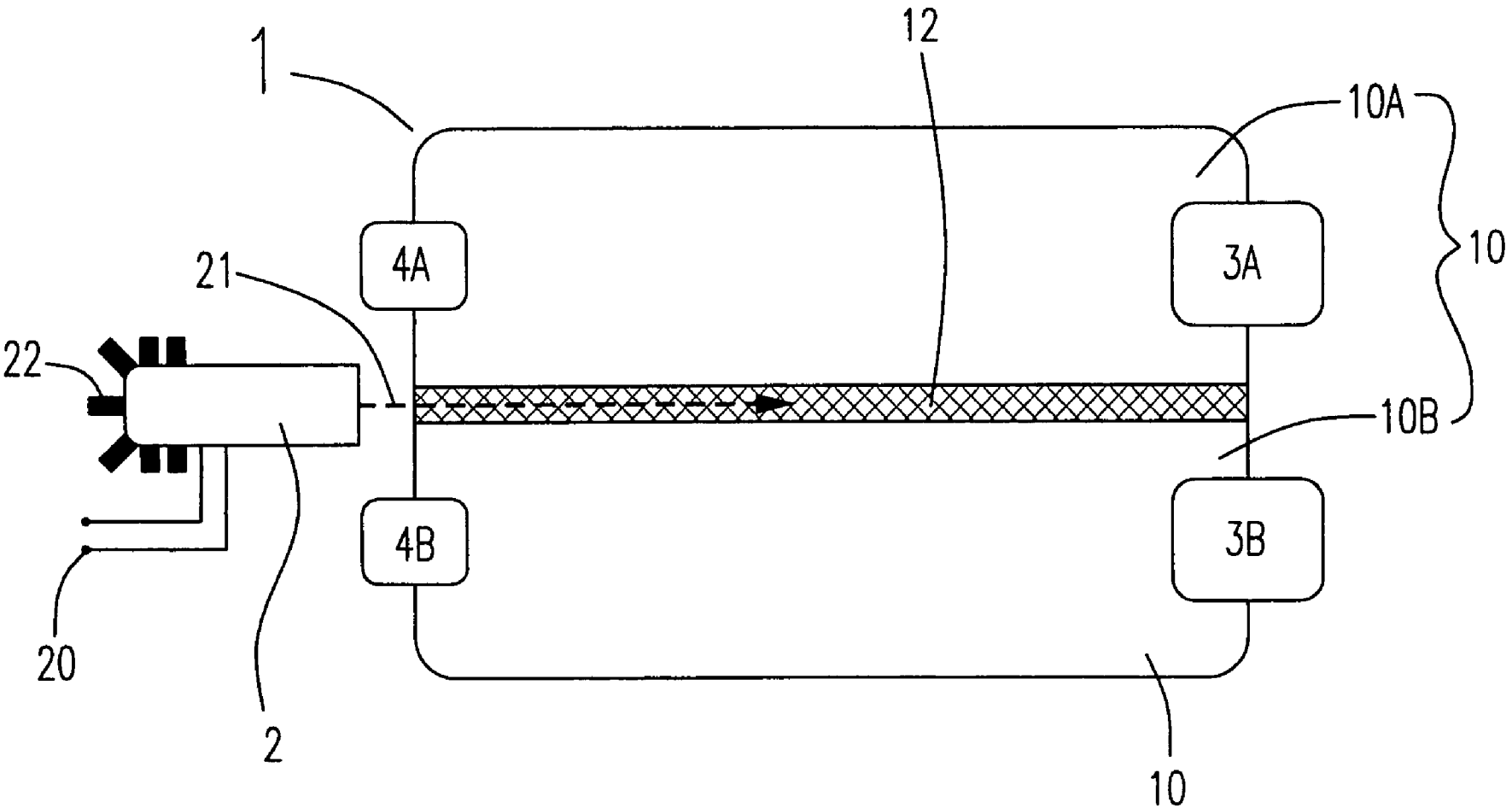
FIG. 3 is a diagram illustrating the structure of the double-acting device for generating synthetic jets according to a second embodiment of the present invention.

Please refer to FIG. 3, which illustrates the structure of the double-acting device for generating synthetic jets according to the second embodiment of the present invention. The arrangement inside the chamber 10 is completely the same as that of the double-acting device 1 according to the first embodiment, which is described in FIG. 2(*a*) in detail. In the double-acting device 1 according to the second embodiment, however, the control circuit 2 is configured outside the chamber 10, and the electricity needed is provided by the power supply 20.

Such a configuration makes the design of the chamber 10 much simpler and prevents the additional heat generation inside the chamber 10, however, it is necessary to be mentioned that an additional connector 21, such as a mechanical connector or an electromagnetic connector, is needed to be located between the control circuit 2 and the diaphragm 12 for helping the control circuit 2 drive the diaphragm 12. Moreover, an independent heat sink configured on the control circuit 2 is also permitted. By a design of the extended surfaces 22, the heat radiation and convection are enhanced to achieve a great cooling effect. Furthermore, the control circuit 2 is able to be arranged partially inside the chamber 10 and partially outside the chamber 10, if necessary.

Figure 4:
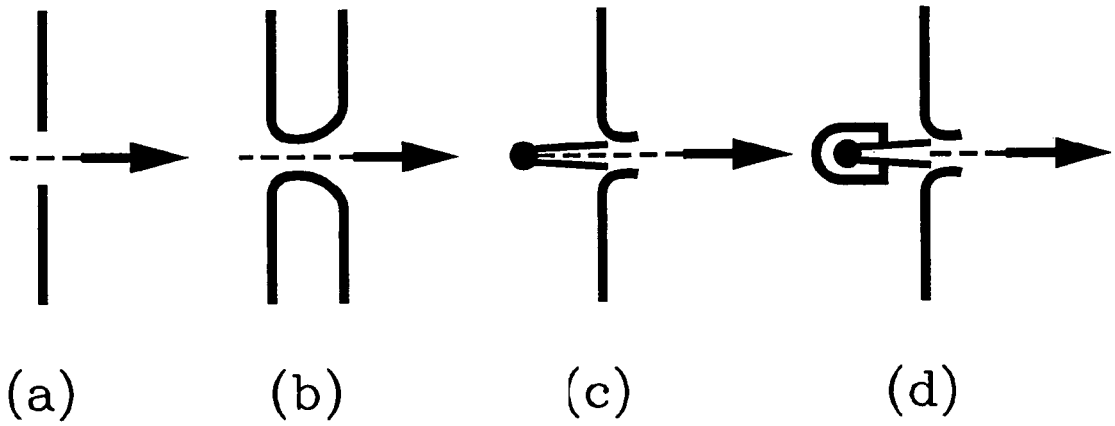
FIGS. 4(*a*) to 4(*d*) are diagrams respectively illustrating the fluid flowings through four different jetting elements during the up-stork of the double-acting device according to the present invention.
Figure 5:
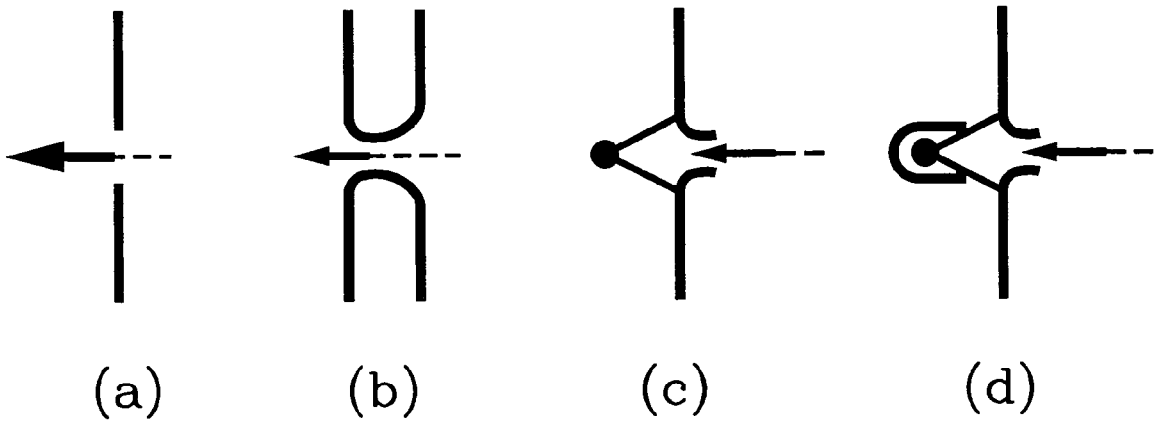
FIGS. 5(*a*) to *f*(*d*) are diagrams respectively illustrating the fluid flowings through four different jetting elements during the back-stork of the double-acting device according to the present invention.

Please refer to FIGS. 4(*a*) to 4(*d*) and FIGS. 5(*a*) to 5(*d*), which respectively illustrate the fluids flowing through four different fluid jetting elements, wherein the arrows represent the flowing direction of the fluid. Such jetting elements are further applied for being the input elements and the output elements in the double-acting device of the present invention. The jetting element, as shown in FIGS. 4(*a*) and 5(*a*), is a symmetric element, such as a slot or an orifice. The shape and the structure of such a element is symmetric, so that the flow rate and the field distribution at both sides of the element have no significant differences, when the fluids are flowing through the jetting element from the left side to the right side thereof, as shown in FIG. 4(*a*), or flowing oppositely, as shown in FIG. 5(*a*).

Referring to FIG. 4(*b*) and FIG. 5(*b*), when the fluids are flowing through a passive asymmetric element, such as a nozzle or a vortex valve, the fluids would be rectified by such a jetting element. Owing to the asymmetric shape of the jetting element and the absence of valves, there would be a difference in flowing when the fluid flows from a different side of the jetting element. This may further result in variations in the flow rate or the velocity in various directions. FIG. 4(*b*) illustrates the fluid flowing from the left side of the jetting element to the right side, and on the other hand, FIG. 5(*b*) illustrates the fluid, which flows oppositely. As shown in FIG. 5(*b*), a large pressure difference between both sides of the asymmetric element is generated due to the asymmetric structure of the jetting element when the fluid flows from the right side to the left side. Such a pressure difference will result in the decrement of the flow rate, and moreover, it is able to be considered that the jetting element is at a partially closed state.

FIGS. 4(*c*) and 4(*d*), and FIGS. 5(*c*) and 5(*d*) are diagrams respectively illustrating the fluid flowing through a passive and an active asymmetric elements, which have a characteristic of "full diode", including the passive and active one-way valves. There are many known types of these valves. FIG. 4(*c*) and FIG. 5(*c*) respectively illustrate the motion of the fluid when the fluid flows from the left side to the right side of the passive asymmetric element, i.e. being at an open state, and the motion of the fluid when the fluid flows oppositely, i.e. being at a closed state. Moreover, FIG. 4(*d*) and FIG. 5(*d*) respectively show the motion of the fluid when the fluid flows from the left side to the right side of the active one-way element, i.e. being at an open state, and the motion of the fluid when the fluid flows oppositely, i.e. being at a closed state. That is to say, the fluid is only permitted to flow from the left sides of the jetting elements to the right side thereof, which results in a one-way flowing of the fluid.

Based on the above, while using the asymmetric elements as the input elements and the output elements in the double-acting device, the differences in the flow rates and the variation of the fluid field are generated when the fluid is sucked in and jetted out through the asymmetric input (output) elements by controlling the valves with cooperation of the various arrangements of the elements. Therefore, the Non-Zero-Net-Mass-Flux fluid is generated accordingly.

Figure 6A:
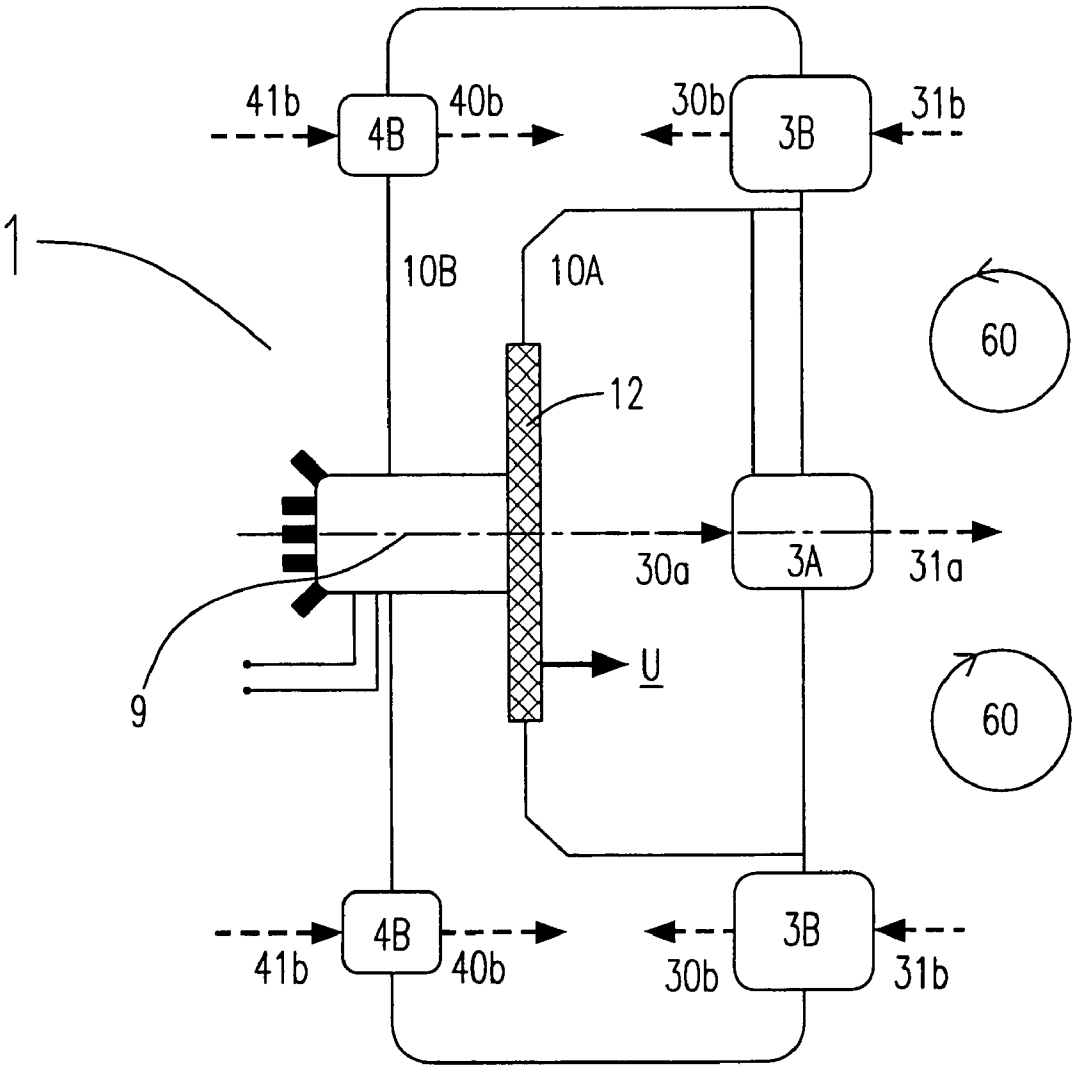
FIGS. 6(*a*) and 6(*b*) are diagrams illustrating the structures of the double-acting device for generating synthetic jets according to a third embodiment of the present invention.
Figure 6B:
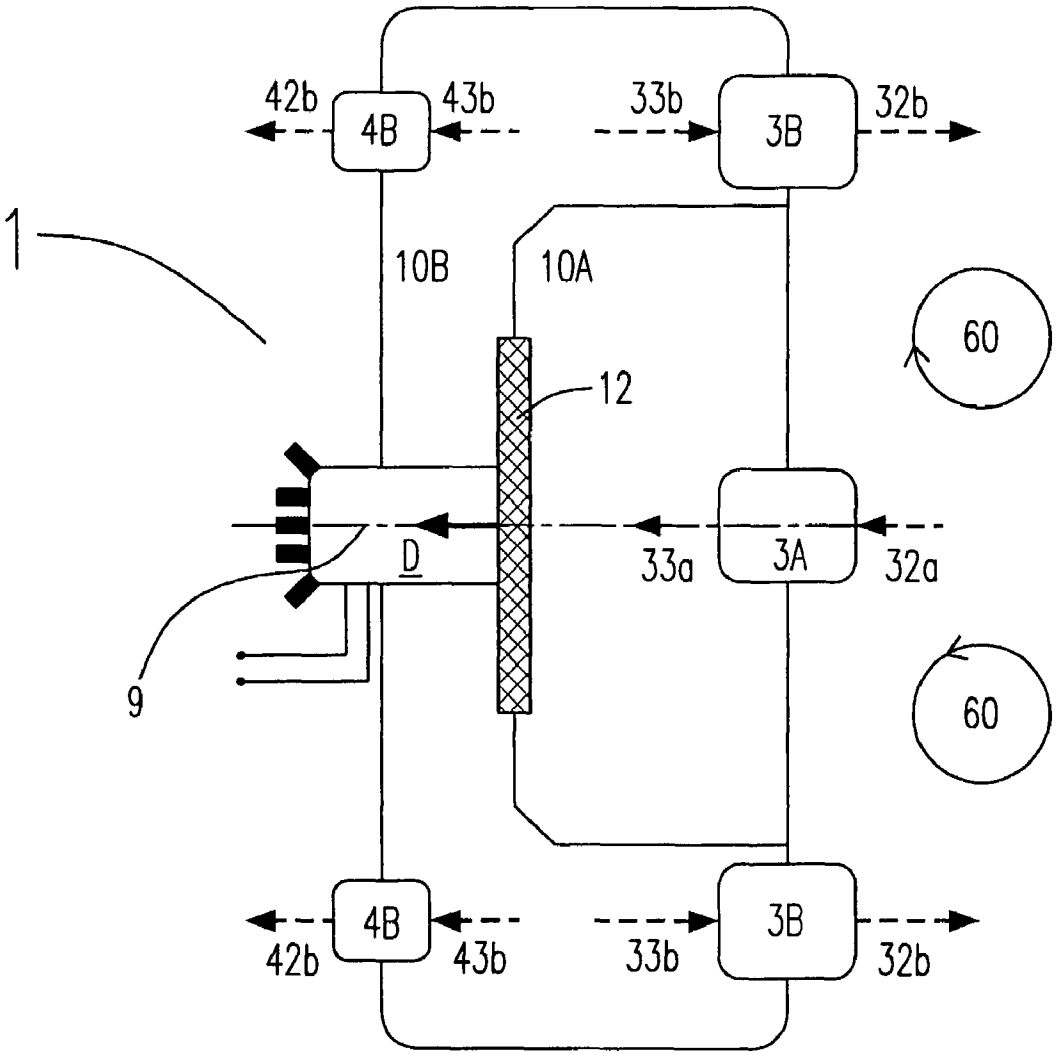

Please refer to FIGS. 6(*a*) and 6(*b*), which illustrate the structure of the double-acting device for generating synthetic jets according to a third embodiment of the present invention. Compared with the forgoing embodiments, is the difference therebetween are the structure of the double-acting device 1 and, accordingly, the arrangements of the sub-chambers 10A and 10B, the output elements 3A and 3B, and the input element 4B. As shown in FIGS. 6(*a*) and 6(*b*), the double-acting device 1 has an axisymmetric structure with the symmetric axis 9, and the output elements 3A and 3B are axisymmetrically arranged relative to the symmetric axis 9. The action and function of the fluid 30*a*, 31*a*, 30*b*, 31*b*, 40*b*, 41*b*, 32*a*, 33*a*, 32*b*, 33*b*, 42*b* and 43*b*, and the vortices 60 in the double-acting device 1 according to this embodiment are respectively similar to those according to the above embodiments as shown in FIGS. 2(*b*) and 2(*c*), no matter the double-acting device 1 is during the up-stroke, i.e. the diaphragm 12 acts toward the U direction, as shown in FIG. 6(*a*), or during the back-stroke, i.e. the diaphragm 12 acts toward the D direction, as shown in FIG. 6(*b*).

In each reciprocating action of the diaphragm 12, some fluid is sucked into the double-acting device 1 through the input element 4B, and another fluid is simultaneously jetted out from the double-acting device 1 through the output elements 3A and 3B. The fluids inside and outside the double-acting device 1 are hence exchanged effectively. Furthermore, two vortices 60 generated by means of the diaphragm 12 reciprocatingly acting will be further enhanced through the streams countered to each other, which are generated when the fluid flows through the axisymmetrical arranged output elements 3A and 3B. More surrounding fluids are hence drawn and rolled by the enhanced vortices to further reinforce the cooling of the synthetic jets.

Figures 7A, 7B, 7C:
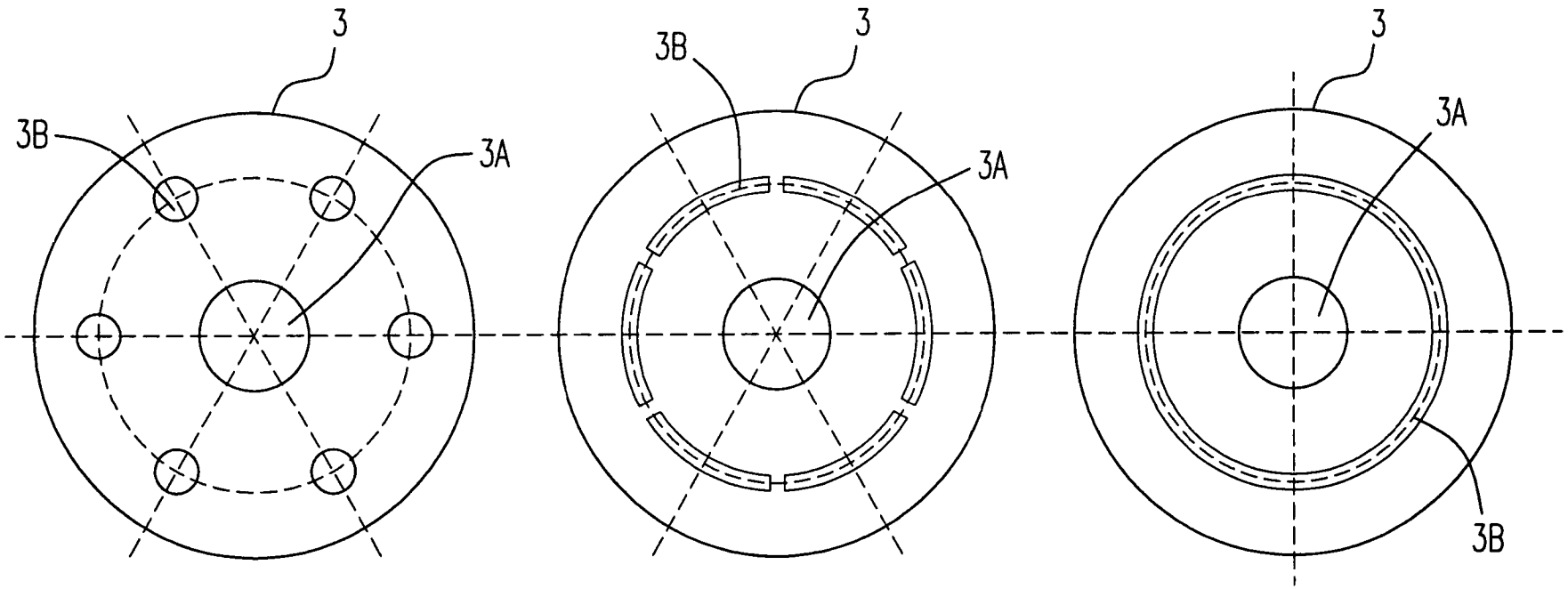
FIGS. 7(*a*) to 7(*c*) are diagrams schematically illustrating the various arrangements of the output elements with different shapes in the double-acting device according to the third embodiment of the present invention.

Please further refer to FIGS. 7(*a*) to 7(*c*), which are sectional diagrams respectively illustrating the different shapes and axisymmetrical arrangements of the output elements 3A and 3B in the output system 3 of the double-acting device 1 according to the third embodiment of the present invention. Viewing the output system 3 along the symmetric axis 9 (in FIGS. 6(*a*) and 6(*b*)) from the outside of the double-acting device, the output elements 3A and 3B having different shapes are accordingly configured in the arrangements shown in FIGS. 7(*a*) to 7(*c*), and moreover, other shapes and arrangements are permitted to be used in the double-acting device.

As shown in FIG. 7(*a*), the output system 3 includes a central output element 3A with a round shape and a set of output elements 3B with the same shape surrounding the central output element 3A. In FIG. 7(*b*), the output system 3 relates to an individual set of output elements 3B with a segment shape arranged around the central output element 3A with a round shape, and in FIG. 7(*c*), the output system 3 has a central output element 3A with a round shape and an annular output element 3B, which rounds the central element 3A.

By such arrangements in FIGS. 7(*a*) to 7(*c*), more vortices would be generated for the antiphase oscillation of the fluid by the double-acting device 1 of the present invention. Such a result is similar to that of the paired arrangements of the output system 3 according to the first embodiment in FIG. 2(*a*).

Figure 8B:
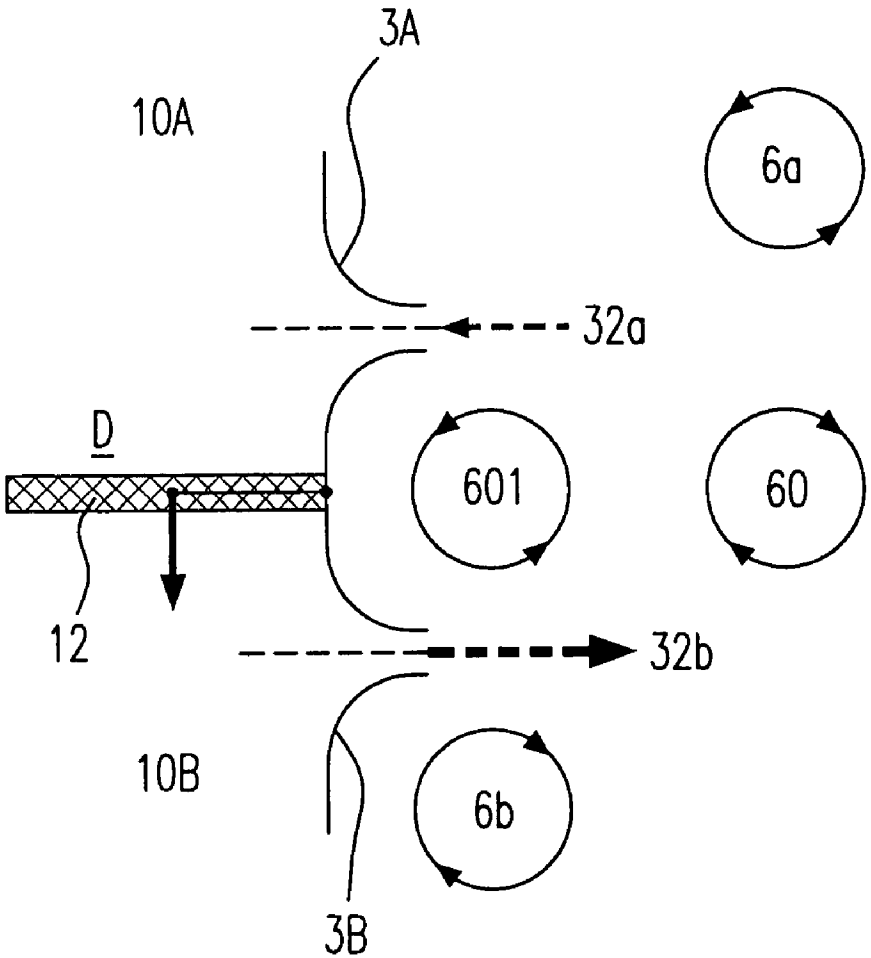
FIGS. 8(*a*) and 8(*b*) illustrate the field distributions near the outlets of the jetting elements.
Figure 8A:
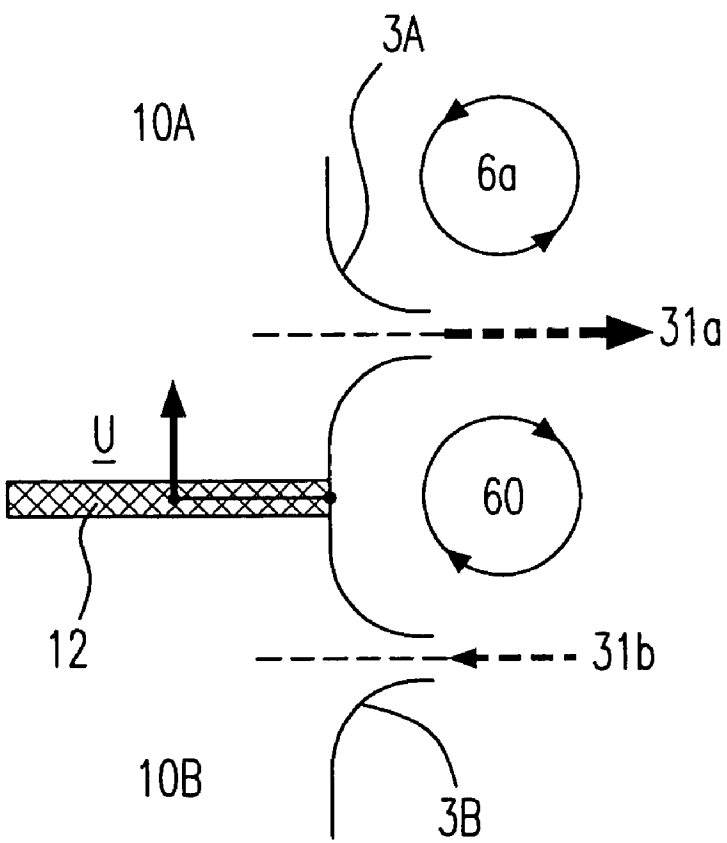

Please refer to FIGS. 8(*a*) and 8(*b*), which illustrate the field distributions near the outlets of the output elements, wherein the output elements 3A and 3B are passive asymmetric output elements as shown in FIG. 4(*b*), such as nozzles or vortex valves, with rectification effects. Referring to FIG. 8(*a*), the diaphragm 12 acts toward the U direction and pushes the fluid in the sub-chamber 10A when the double-acting device is acting during the up-stroke. The fluid is pushed and jetted out from the sub-chamber 10A through the output element 3A, and the jets 31*a* are hence generated. The fluid field outside the double-acting device is changed by the generation of the jets 31*a*, and, accordingly, a pair of vortices 60 and 6*a* are formed. By an appropriate design for another output element 3B, the fluid 31*b* outside the double-acting device is sucked into the sub-chamber 10B, simultaneously. The flowing of the fluid 31*b* also results in a variation of the surrounding field, and such a variation further enhances the vortex 60 between the output elements 3A and 3B. After being enhanced, the vortex 60 will run downstream and away from the double-acting device. Similarly, a new pair of vortices 601 and 6*b* would be formed by the diaphragm 12 acting toward the D direction, and at the same moment, the vortex 601 is enhanced when the fluid 32*a* is sucked into the sub-chamber 10A.

Therefore, when the double-acting device of the present invention acts, a train of enhanced vortices would be always generated, no matter which direction the diaphragm 12 acts toward. Additionally, the enhanced vortices could further force the fluid outside the double-acting device to flow and convect for a more effective cooling.

Figure 9:
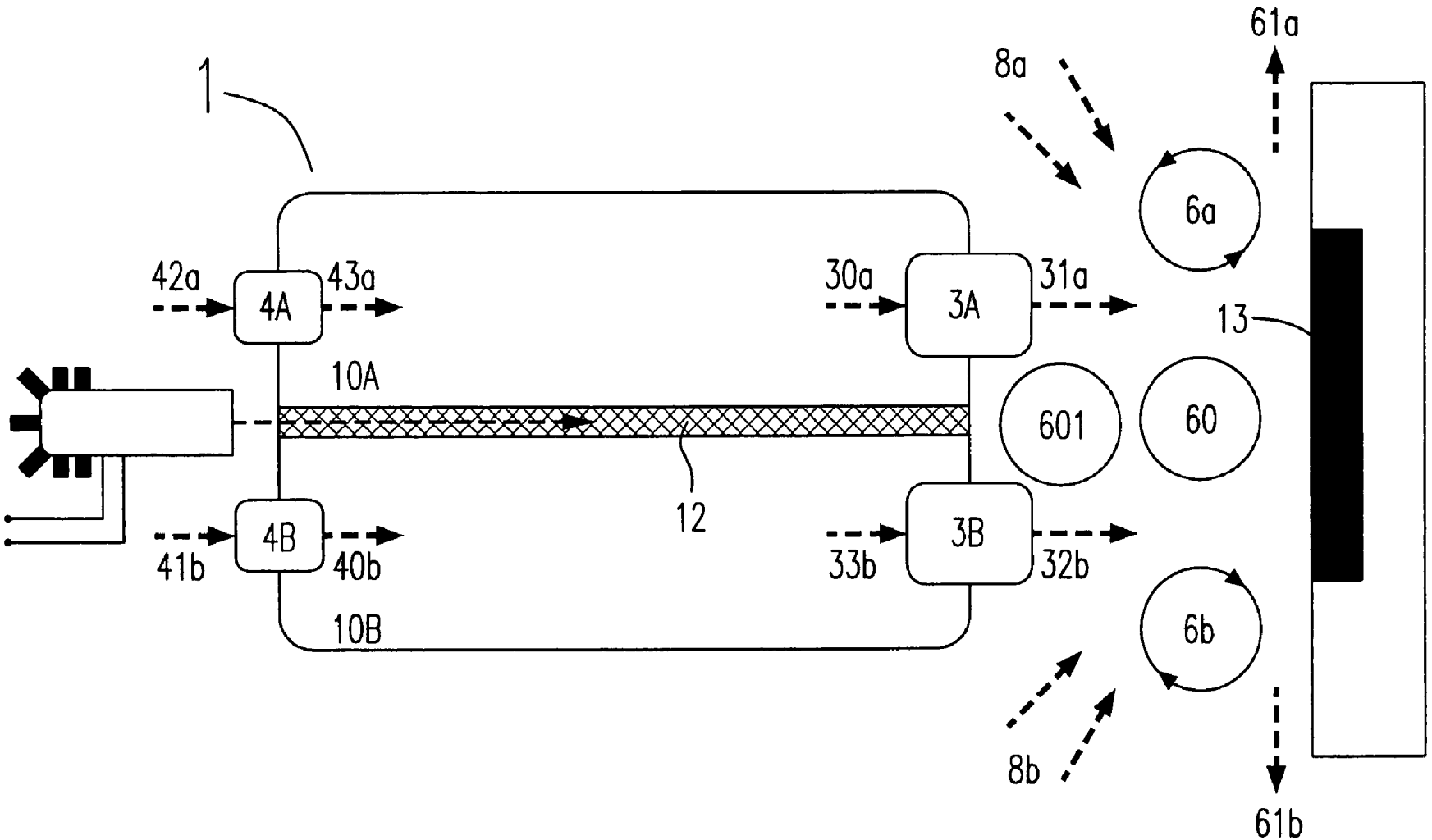
FIG. 9 is a diagram illustrating the cooling for an open system by the Non-Zero-Net-Mass-Flux fluid generated according to the present invention.

Please refer to FIG. 9, which illustrates the cooling for an open system having a heat body therein by the Non-Zero-Net-Mass-Flux fluid generated by the double-acting device according to the present invention. First, a double-acting device 1, which is mentioned above, is provided on one side of the surface of the heat body 13, which needs to be cooled. Then, the diaphragm 12 of the double-acting device 1 is controlled to make the diaphragm 12 reciprocatingly act. Accordingly, when a reciprocating full action including the up-stroke and the back-stroke of the diaphragm 12 is completed, vortices 6*a* and 6*b* and enhanced vortices 60 and 601 would be formed, and jets 31*a* and 32*b* would be generated. The jets 31*a* and 32*b* would be directly and vertically impinged to the surface of the heat body 13 orderly, and further horizontally flowed away from the heat body 13, such as the fluids 61*a* and 61*b*. As a result, heat of the heat body 13 is partially taken away. Moreover, vortices 6*a* and 6*b* and enhanced vortices 60 and 601 also help for the heat dissipation of the heat body 13 for the continuous mutual interactions among the vortices 6*a*, 6*b*, 60 and 601.

What worthy to say is that, for the variation of the fluid field surrounding the double-acting device, the fresh fluids 8*a* and 8*b* with a lower temperature are also involved in the field interaction. Moreover, the fluids 42*a* and 41*b*, which have a much lower temperature and are much far from the heat body 13 and less influenced thereby, are respectively sucked into the sub-chamber 10A and 10B through the input elements 4A and 4B. Therefore, the fluids in the sub-chambers 10A and 10B are exchangeable, which may further help the cooling for the heat body 13.

Figure 10:
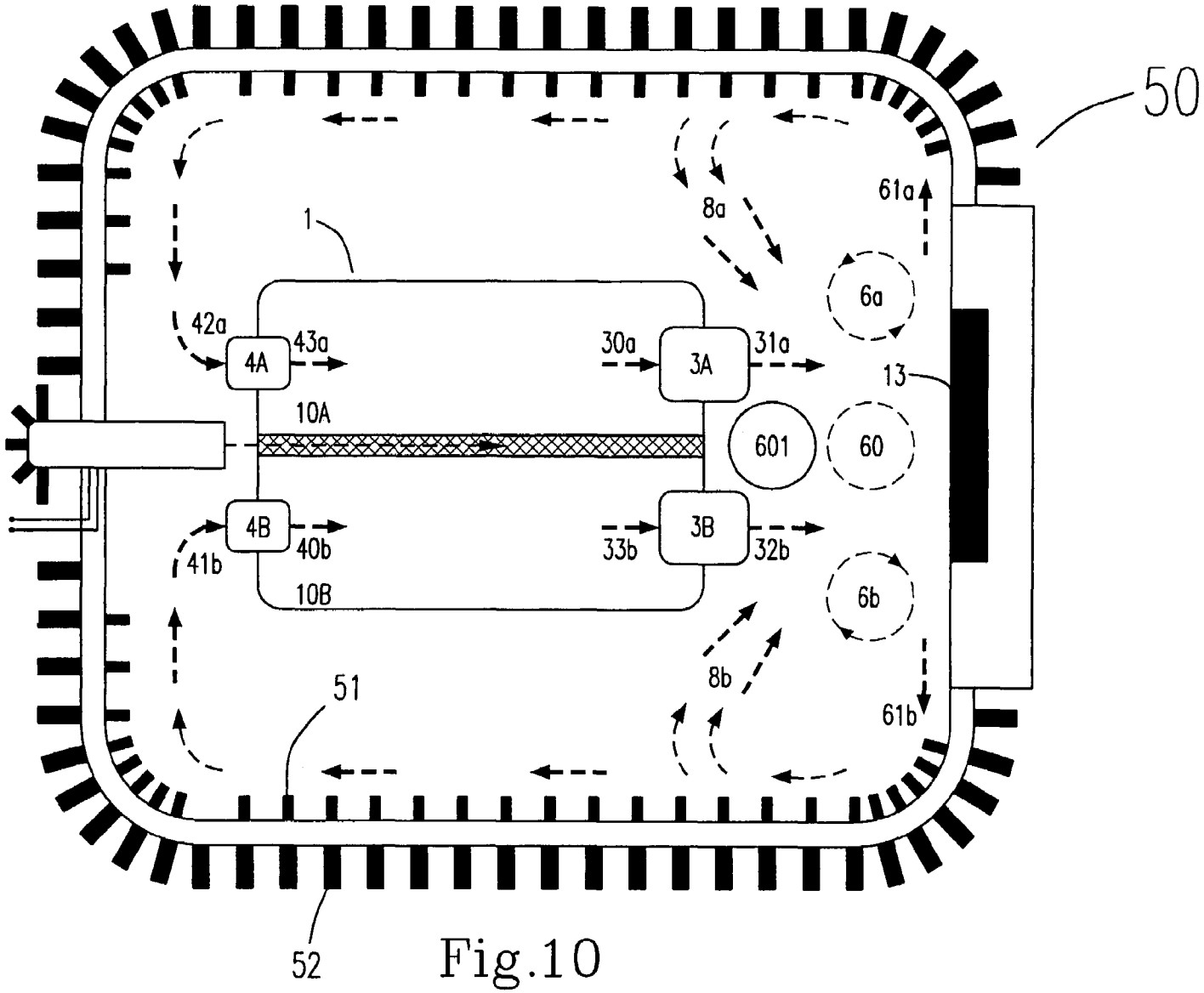
FIG. 10 is a diagram illustrating the cooling for a closed system by the Non-Zero-Net-Mass-Flux fluid generated according to the present invention.

Please refer to FIG. 10, which illustrates the cooling for a closed system having a heat body therein by the Non-Zero-Net-Mass-Flux fluid generated by the double-acting device according to the present invention. Compared with the cooling for the open system in FIG. 9, the fluids 8*a* and 8*b* in the closed system having a heat body 13, and the fluids 42*a* and 41*b* would have higher temperatures. However, owing to the reciprocating action of the double-acting device 1, the fluid is pumped for flowing roundly in the closed system 50, which improves the heat of the closed system 50 transferring out from the internal wall 51 of the closed system 50. Besides, both of the internal wall 51 and the external wall 52 can be constituted as extended surfaces, such as fins, to augment the heat transfer of the closed system 50.

Based on the above, it is known that the Non-Zero-Net-Mass-Flux jets have more advantages when compared with the conventional Zero-Net-Mass-Flux jets. Therefore, the range of the parameters, which are necessary to be controlled for the heat transfer and the fluidic applications, is broadened by the present invention. Accordingly, the present invention is more potential in the fluid controlling in not only the common scales, but also the micro scales, such as in the micro electro-mechanical system (MEMS).

The double-acting device provided by the present invention and the cooling method used the same adopt a device of double-chamber in cooperation with an arrangement of at least one input element and plural output elements to make the fluid with Non-Zero-Net-Mass-Flux jets to be jetted due to the working fluid circulating in each reciprocating action of the diaphragm. Since the fluid is sucked into the chamber and jetted out at the same time when the double-acting device is operated for the jets generation, the antiphase jets are accordingly formed. Furthermore, by the mutual interaction of the antiphase jets, the vortex formed by the double-acting device is further enhanced.

Therefore, the double-acting device of the present invention provides a more effective heat dissipation and a better cooling effect than that provided by the conventional ones, which only generates a Zero-Net-Mass-Flux fluid in a full working cycle including the up-stroke and the back-stroke. The double-acting device of the present invention is more constitutive in the improvements for the highly heat dissipating technology.

In conclusion, the double-acting device of the present invention is able to be used as a stand-alone device for cooling and accordingly has the following advantages.

First, the Non-Zero-Net-Mass-Flux jets generated by the double-acting device according to the present invention would make the surface of the heat body have an extremely high heat transfer efficiency, because the jets directly impinge to a heat surface and the fluid for cooling would be exchanged and the vortex is able to be enhanced.

Second, the geometrical structure of the double-acting device is quite simple. Additional devices, such as the pipes, blowers and some other moving parts, which are necessary in the conventional actuators, are not required in the double-acting device of the present invention. Therefore, the cooling system, which has the double-acting device provided by the present invention, exhibits a great flexibility in designs and applications, and would be very compact, spatially economical and cost-effective.

Finally, the double-acting device and the cooling method used the same provided by the present invention can be further applied in a closed system, and the heat body therein is able to be effectively cooled by a forced heat convection. No additional fluid outside the closed system is required.

Hence, the present invention not only has a novelty and a progressive nature, but also has an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A double-acting device for generating a synthetic jet, comprising:

a chamber having a cavity for a working fluid;

a separating element dividing said chamber into at least two sub-chambers;

a control system connected to said chamber for controlling said separating element to act reciprocatingly;

an input system connected to said chamber for inputting said working fluid to said chamber therethrough, wherein said input system comprises at least one non-movable rectification element causing that the flow rate is relatively lower at a flow direction through said input system out of the sub-chamber and is relatively higher at a flow direction through said input system into the sub-chamber; and an output system connected to said chamber for outputting said working fluid from said chamber therethrough, wherein said output system comprises at least two sets of passages respectively connected to said at least two sub-chambers, so that when said working fluid is pushed and pulled through said at least two sets of passages by a reciprocating action of said separating element, a train of vortices are generated and enhanced by two counter streams of working fluids simultaneously pushed and pulled through said at least two sets of passages and a non-zero-net-mass-flux fluid is generated through a designed structure and a defined arrangement of said input system and said output system.

2. The double-acting device according to claim 1, wherein said separating element is a piston.

3. The double-acting device according to claim 2, wherein said control system is a system of connecting rods.

4. The double-acting device according to claim 1, wherein said separating element is a diaphragm.

5. The double-acting device according to claim 4, wherein said diaphragm is one of a piezoelectric film and a phono-electric film.

6. The double-acting device according to claim 5, wherein said control system is a control circuit.

7. The double-acting device according to claim 1, wherein said input system and said output system further comprise a first control valve and a second control valve respectively.

8. The double-acting device according to claim 7, wherein said first control valve and said second control valve are selected from an active valve and a passive valve.

9. The double-acting device according to claim 8, wherein said input system further comprises at least an input element.

10. The double-acting device according to claim 9, wherein said input element is one of a diffuser and an orifice.

11. The double-acting device according to claim 1, wherein said at least two sets of passages are selected from nozzles and orifices.

12. The double-acting device according to claim 1 wherein said at least two sets of passages are coaxially arranged.

13. The double-acting device according to claim 1, wherein said defined arrangement is one of a paired arrangement and an axisymmetric arrangement.

14. A double-acting device for generating a synthetic jet, comprising:

a chamber having a cavity for a working fluid;

a separating element dividing said chamber into at least two sub-chambers;

a control system connected to said chamber for controlling said separating element to act reciprocatingly; and at least two sets of passages respectively connected to said at least two sub-chambers, wherein said at least two sets of passages are non-movable asymmetric jetting devices causing that the flow rate is relatively higher at a flow direction through said at least two sets of passages out of the sub-chamber and is relatively lower at a flow direction through said at least two sets of passages into the sub-chamber, so that when said working fluid is pushed and pulled through said at least two sets of passages by a reciprocating action of said separating element, a train of vortices are generated and enhanced by two counter streams of working fluids simultaneously pushed and pulled through said at least two sets of passages, and a non-zero-net-mass-flux fluid is generated through a designed structure and a defined arrangement of said at least two sets of passages.

* * * * *